US007678751B2

(12) United States Patent
Park et al.

(10) Patent No.: US 7,678,751 B2
(45) Date of Patent: Mar. 16, 2010

(54) COMPOSITION FOR REMOVING PHOTORESIST, METHOD OF REMOVING PHOTORESIST AND METHOD OF MANUFACTURING A SEMICONDUCTOR DEVICE USING THE SAME

(75) Inventors: Jung-Dae Park, Gyeonggi-do (KR); Sang-Eon Lee, Gyeonggi-do (KR); Sang-Mun Chon, Gyeonggi-do (KR); Yang-Koo Lee, Gyeonggi-do (KR); Dong-Chul Heo, Gyeonggi-do (KR); Pil-Kwon Jun, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1134 days.

(21) Appl. No.: 11/296,000

(22) Filed: Dec. 6, 2005

(65) Prior Publication Data

US 2006/0122084 A1 Jun. 8, 2006

(30) Foreign Application Priority Data

Dec. 6, 2004 (KR) ..... 10-2004-0101679

(51) Int. Cl.
*C11D 7/50* (2006.01)

(52) U.S. Cl. ..... 510/175; 510/176; 134/1.3

(58) Field of Classification Search ..... 510/175, 510/176; 134/1.3
See application file for complete search history.

(56) References Cited

U.S. PATENT DOCUMENTS

2002/0037819 A1* 3/2002 Sahbari ..... 510/175
2004/0220066 A1* 11/2004 Rutter, Jr. ..... 510/175
2005/0202987 A1* 9/2005 Small et al. ..... 510/175

FOREIGN PATENT DOCUMENTS

| | | |
|---|---|---|
| JP | 04-350660 | 12/1992 |
| JP | 08-087118 | 4/1996 |
| JP | 2004-029346 | 1/2004 |
| KR | 0184307 | 12/1998 |
| KR | 0440484 | 7/2004 |
| WO | WO 2004/019134 | 3/2004 |

OTHER PUBLICATIONS

English language abstract of Korean Publication No. 0184307.
English language abstract of Korean Publication No. 0440484.
English language abstract of Japanese Publication No. 08-087118.
English language abstract of Japanese Publication No. 04-350660.
English language abstract of Japanese Publication No. 2004-029346.

* cited by examiner

*Primary Examiner*—Gregory E Webb
(74) *Attorney, Agent, or Firm*—Harness, Dickey & Pierce, P.L.C.

(57) ABSTRACT

Disclosed are a composition for removing photoresist, a method of removing photoresist and a method of manufacturing a semiconductor device using a composition. The composition may include a ketone compound and a first polar aprotic solvent. The composition may also include the ketone compound and a second polar aprotic solvent. Moreover, the composition may include the first polar aprotic solvent and a second polar aprotic solvent with or without the ketone compound. The first polar aprotic solvent has at least one of an ether compound and an ester compound, and the second polar aprotic solvent has at least one of a sulfur-containing compound and a nitrogen-containing compound.

39 Claims, 12 Drawing Sheets

COMPOSITION FOR REMOVING PHOTORESIST, METHOD OF REMOVING PHOTORESIST AND METHOD OF MANUFACTURING A SEMICONDUCTOR DEVICE USING THE SAME

CROSS REFERENCE TO RELATED APPLICATIONS

This application claims priority under 35 USC § 119 to Korean Patent Application No. 2004-101679 filed on Dec. 6, 2004, the contents of which are herein incorporated by reference in its entirety.

BACKGROUND OF THE INVENTION

1. Field of the Invention

The present invention relates to a composition for removing photoresist, a method of removing photoresist and a method of manufacturing a semiconductor device using the same.

2. Description of the Related Art

In a semiconductor manufacturing process, an integrated circuit is generally formed using a photolithography process. Photoresist used in the photolithography process may be denatured in a plasma etching process to form a polymer that is not easily removed from a substrate. The polymer includes photoresist residues, organic impurities or etching residues generated in the plasma etching process. The plasma etching residues are largely formed on sidewalls of a pattern and thus are not easily removed by a cleaning solution for removing photoresist.

Cleaning solutions including hydroxylamine or a fluorinated compound have been used for conventional semiconductor cleaning processes. For example, a cleaning solution including a fluorinated compound is disclosed in Japanese Laid-Open Patent Publication No. 2004-29346. The cleaning solution includes a strong nucleophilic compound. The nucleophilic compound easily decomposes a denatured polymer. The cleaning solution may decompose and dissolve the denatured polymer and plasma etching residues regardless of the types of photoresist used in the photolithography process.

Recently, various types of metal have been introduced in a semiconductor manufacturing process, and patterns of the integrated circuit have been formed using the metal. However, the cleaning solutions may not remove a composite of metal and polymer, and/or the cleaning solutions may corrode metal patterns. Further, the cleaning solutions may not be used in a process that requires selective removal of photoresist. For example, the cleaning solutions may not be applied in a color filter manufacturing process for a CMOS image sensor (CIS), because the cleaning solutions may remove all types of photoresist nonselectively, including photoresist that constitutes a lens of the color filter.

A photoresist stripping composition including alkanolamine, a sulfone compound, a sulfoxide compound, etc. is disclosed in Japanese Laid-Open Patent Publication No. 1992-350660. A photoresist stripping composition including N-alkanolamine is disclosed in Japanese Laid-Open Patent Publication No. 1996-87118. The photoresist stripping compositions have relatively good photoresist removability and good composition stability. However, as process conditions increase in magnitude, the photoresist stripping compositions may not completely remove photoresist. For example, when the process temperature is higher than about 120° C., the photoresist may be post-baked or severely denatured. Thus, the severely denatured photoresist may not be completely removed by the photoresist stripping compositions.

A ketone-based cleaning solution has been used for removing specific photoresist in a color filter manufacturing process for a CIS. The ketone-based cleaning solution has a strong dissolving ability for photoresist. However, the ketone-based cleaning solution may not dissolve the denatured photoresist completely and the ketone-based cleaning solution may not selectively remove a particular type of photoresist. In addition, the ketone-based cleaning solution has a high volatility, and thus, when a processing wafer is moved for performing a subsequent process, undissolved photoresist may be readsorbed onto the processing wafer. The readsorbed photoresist may cause a processing failure in a subsequent process.

Therefore, it would be highly desirable to have a composition that has excellent photoresist removability, and also selectively removes a particular type of photoresist.

SUMMARY

Embodiments of the present invention provide a composition for removing photoresist, the composition being able to remove novolac-based photoresist selectively. Embodiments of the present invention also provide a method of removing photoresist using the composition. Furthermore, embodiments of the present invention still also provide a method of manufacturing a semiconductor device using the composition.

A composition for removing photoresist, a method of removing photoresist and a method of manufacturing a semiconductor device using a composition are provided. The composition may include a ketone compound and a first polar aprotic solvent. The composition may also include the ketone compound and a second polar aprotic solvent. Moreover, the composition may include the first polar aprotic solvent and a second polar aprotic solvent with or without the ketone compound.

The composition for removing photoresist may comprise a ketone compound and/or a first polar aprotic solvent and/or a second polar aprotic solvent. The ketone compound may comprise at least one selected from the group consisting of acetone, 2-butanone and methyl isobutylketone. The first polar aprotic solvent may comprise at least one of an ether compound and an ester compound. The second polar aprotic solvent may comprise at least one of a sulfur-containing compound and a nitrogen-containing compound. The ether compound may comprise at least one of propylene glycol methyl ether, ethylene glycol methyl ether or a mixture thereof. The ester compound may comprise at least one of ethyl lactate, propylene glycol methyl ether acetate, ethylene glycol methyl ether acetate, γ-butyrolactone, ethyl 3-ethoxypropionate, carbitol acetate and dimethyl adipate. As for the sulfur-containing compound, it may comprise at least one of dimethylsulfoxide, sulfolane or a mixture thereof. Regarding the nitrogen-containing compound, it may comprise at least one of N-methyl-2-pyrrolidinone, dimethylformamide, dimethylacetamide, diethylacetamide and acetonitrile.

The composition may further comprise a basic organic solvent. The basic organic solvent may comprise a tetraalkylammonium hydroxide compound, an alkanolamine compound or a mixture thereof. The tetraalkylammonium hydroxide compound may comprise tetramethylammonium hydroxide, tetraethylammonium hydroxide or a mixture thereof, and the alkanolamine compound may comprise at least one selected from the group consisting of monoethanolamine, diethanolamine, isopropanolamine and triethanolamine. In another embodiment, the composition for removing photoresist may comprise from about 100 up to about 500 ppm by weight of the basic organic solvent, based on a total weight of the composition.

The composition for removing photoresist may preferably comprise from about 20 up to about 80 percent by weight of the ketone compound and from about 20 up to about 80 percent by weight of the polar aprotic solvent, based on a total weight of the composition. More preferably, the composition for removing photoresist may comprise from about 50 to about 80 percent by weight of the ketone compound and about from 20 to about 50 percent by weight of the polar aprotic solvent, based on a total weight of the composition.

The composition for removing photoresist may preferably comprise from about 10 up to about 80 percent by weight of the first polar aprotic solvent and from about 20 up to about 90 percent by weight of the second polar aprotic solvent, based on a total weight of the composition. More preferably, the composition for removing photoresist may comprise from about 10 up to about 50 percent by weight of the first polar aprotic solvent and from about 50 up to about 90 percent by weight of the second polar aprotic solvent, based on a total weight of the composition.

A method of removing photoresist is also provided. The method comprises preparing a composition for removing photoresist. Such a composition is described above. Then, the photoresist is removed from an object by contacting the photoresist formed on the object with the composition. The photoresist may comprise a novolac resin. The photoresist may be removed using a batch-type cleaning apparatus. The photoresist may be immersed in the composition for about 5 minutes up to about 20 minutes. The photoresist may be contacted with the composition for from about 30 seconds up to about 5 minutes. The photoresist may be removed using a single-type cleaning apparatus. The composition may have a temperature in a range of from about 10° C. up to about 45° C.

A method of manufacturing a semiconductor device is also provided. The method comprises forming a structure on a substrate. Next, a photoresist pattern is formed on the substrate, the photoresist pattern exposing a portion of the structure. Then, the photoresist pattern is removed from the substrate by applying a composition for removing photoresist. The composition may include a ketone compound and/or a first polar aprotic solvent, and/or a second polar aprotic solvent, such as those described above.

The structure may be formed by forming a first photosensitive film on the substrate including a photodiode and a metal pattern thereon, by forming a color filter on the first photosensitive film, by forming a second photosensitive film on the first photosensitive film and the color filter, and by forming a microlens on the second photosensitive film. After forming the photoresist pattern, an exposed portion of the structure may be removed by using the photoresist pattern as an etching mask. The method may further comprise removing impurities from the substrate simultaneously with removal of the photoresist pattern. The impurities in one embodiment may comprise an organic polymer, an oxide polymer, a metallic polymer or a mixture thereof. The method in another embodiment may further comprise rinsing the substrate after removal of the photoresist pattern, and drying the substrate. The substrate may be typically rinsed using deionized water. Moreover, the step of forming the structure may comprise all or part of the following: forming a photodiode on the substrate, forming a transistor on the substrate, the transistor being connected to the photodiode, forming an insulation layer on the transistor and the substrate, partially etching the insulation layer to form a first contact hole exposing a portion of the transistor, forming a first metal pad to fill the first contact hole, forming an insulation interlayer on the first metal pad and the insulation layer, partially etching the insulation interlayer to form a second contact hole exposing the first metal pad, forming a second metal pad to fill the second contact hole, forming a first photosensitive film on the second metal pad and the insulation interlayer, forming a color filter on the first photosensitive film, forming a second photosensitive film on the first photosensitive film and the color filter, and forming a microlens on the second photosensitive film.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION

Figure 1:
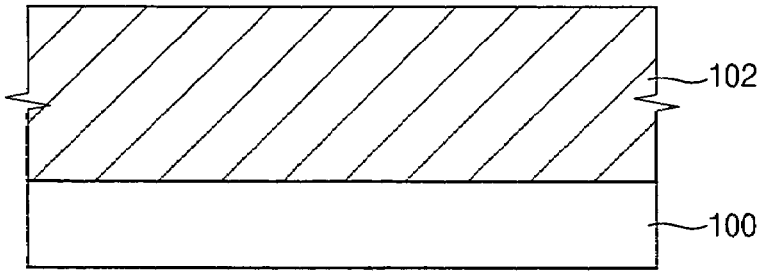
FIGS. 1 to 4 are cross-sectional views illustrating a method of manufacturing a semiconductor device in accordance with an embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

First Exemplary Composition for Removing Photoresist

A first exemplary composition for removing photoresist includes a ketone compound, a first polar aprotic solvent having at least one of an ether compound and an ester compound, and a second polar aprotic solvent having at least one of a sulfur-containing compound and a nitrogen-containing compound.

The ketone compound in this first composition may rapidly wet photoresist formed on a substrate, thereby shortening the process time needed for removal of the photoresist and adjusting the viscosity of the first composition. Examples of this ketone compound may include acetone, 2-butanone, methyl isobutylketone, etc. These can be used alone or in a mixture thereof.

When the first composition includes less than about 20 percent by weight of the ketone compound, the first composition may have an excessively high viscosity, and the process time needed for removal of the photoresist may be longer than desired. In addition, when the first composition includes greater than about 50 percent by weight of the ketone compound, the first composition may have a relatively high volatility and photoresist residues may remain on the substrate after the removal process. Thus, the first composition of the present invention may preferably include from about 20 to about 50 percent by weight of the ketone compound, and more preferably, from about 20 up to about 40 percent by weight of the ketone, based on a total weight of the first composition.

A first polar aprotic solvent in the first composition may dissolve the photoresist detached from a surface of the substrate to thereby prevent readsorption of the detached photoresist onto the substrate.

The first polar aprotic solvent in the first composition includes at least one of an ether compound and an ester compound. Examples of the ester compound in the first polar aprotic solvent may include ethyl lactate, propylene glycol methyl ether acetate, ethylene glycol methyl ether acetate, γ-butyrolactone, ethyl 3-ethoxypropionate, carbitol acetate, dimethyl adipate, etc. These can be used alone or in a mixture thereof.

Examples of the ether compound in the first polar aprotic solvent may include propylene glycol methyl ether, ethylene glycol methyl ether, or a mixture thereof.

When the first composition includes less than about 40 percent by weight of the first polar aprotic solvent, the detached photoresist may be readsorbed onto the substrate. In addition, when the content of the first polar aprotic solvent is greater than about 70 percent by weight, the first composition may have poor solubility with respect to the photoresist. Thus, the first composition of the present invention may preferably include from about 40 up to about 70 percent by weight of the first polar aprotic solvent, and more preferably, from about 40 up to about 60 percent by weight of the first polar aprotic solvent, based on the total weight of the first composition.

The second polar aprotic solvent in the first composition may lower volatility of the first composition. When a composition for removing photoresist has relatively high volatility, the composition may be vaporized before photoresist dissolved in the composition is completely removed from a substrate through a subsequent cleaning process. Thus, a large amount of photoresist residues may remain on the substrate and the photoresist residues may generate process failures in subsequent processes.

The second polar aprotic solvent in the first composition includes at least one of a sulfur-containing compound and a nitrogen-containing compound. Examples of the sulfur-containing compound may include dimethylsulfoxide, sulfolane, etc. These can be used alone or in a mixture thereof.

Examples of the nitrogen-containing compound in the first composition may include N-methyl-2-pyrrolidinone, dimethylformamide, dimethylacetamide, diethylacetamide, acetonitrile, etc. These can be used alone or in a mixture thereof.

When the first composition includes less than about 10 percent by weight of the second polar aprotic solvent, the first composition may have relatively high volatility and complete removal of the photoresist may be difficult. In addition, when the content of the second polar aprotic solvent is greater than about 40 percent by weight, volatility of the first composition may not decrease substantially and thus may not be economical. Thus, the first composition of the present invention may preferably include about 10 to about 40 percent by weight of the second polar aprotic solvent, and more preferably, about 20 to about 40 percent by weight of the second polar aprotic solvent.

The first composition for removing photoresist may further include a basic organic solvent. The basic organic solvent may promote decomposition of the photoresist in a photoresist removal process. Examples of the basic organic solvent may include a tetraalkylammonium hydroxide compound, an alkanolamine compound, etc. These can be used alone or in a mixture thereof.

Examples of the tetraalkylammonium hydroxide compound may include tetramethylammonium hydroxide, tetraethylammonium hydroxide, etc. These can be used alone or in a mixture thereof.

Examples of the alkanolamine compound may include monoethanolamine, diethanolamine, isopropanolamine, triethanolamine, etc. These can be used alone or in a mixture thereof.

When the first composition includes less than about 100 by weight ppm of the basic organic solvent, the basic organic solvent may not sufficiently promote decomposition of the photoresist and the process time needed for removal of the photoresist may be longer than desired. In addition, when the content of the basic organic solvent is greater than about 500 by weight ppm, the first composition may not selectively remove novolac-based photoresist relative to other types of photosensitive material by decomposing the other types of photosensitive material as well as the novolac-based photoresist. For example, in a CMOS image sensor manufacturing process, a color filter including the photosensitive material may be damaged. Therefore, the first composition of the present invention may preferably include from about 100 up to about 500 by weight ppm of the basic organic solvent, based on the total weight of the first composition.

Second Exemplary Composition for Removing Photoresist

A second composition for removing photoresist will be fully described hereinafter. The second composition for removing photoresist can include a ketone compound and a first polar aprotic solvent including at least one of an ether compound and an ester compound. The ketone compound and the first polar aprotic solvent are previously described above so that a further description will be omitted.

When the second composition includes less than about 20 percent by weight of the ketone compound and greater than about 80 percent by weight of the first polar aprotic solvent, the process time needed for removing photoresist may become longer. In addition, when the content of the ketone compound is greater than about 80 percent by weight and the content of the first polar aprotic solvent is less than about 20 percent by weight, the photoresist detached from a surface of the substrate may be readsorbed onto the substrate to generate process failures. Thus, the second composition of the present invention may preferably include from about 20 up to about 80 percent by weight of the ketone compound, and from about 20 up to about 80 percent by weight of the first polar aprotic solvent, and more preferably, from about 50 up to about 80 percent by weight of the ketone compound, and about 20 to about 50 percent by weight of the first polar aprotic solvent.

Third Exemplary Composition for Removing Photoresist

A third composition for removing photoresist will be fully described hereinafter. The third composition for removing photoresist includes a ketone compound and a second polar aprotic solvent including at least one of an ether compound and an ester compound. The ketone compound and the second polar aprotic solvent are previously described so that descriptions of these materials will be omitted.

When the third composition includes less than about 20 percent by weight of the ketone compound and greater than about 80 percent by weight of the second polar aprotic solvent, the process time needed for removing the photoresist may become longer than desired. In addition, when the content of the ketone compound is greater than about 80 percent by weight, and the content of the second polar aprotic solvent is less than about 20 percent by weight, the third composition may have relatively high volatility which generates process failures in subsequent processes. Thus, the third composition of the present invention may preferably include from about 20 up to about 80 percent by weight of the ketone compound and from about 20 up to about 80 percent by weight of the second polar aprotic solvent, and more preferably, from about 50 up to about 80 percent by weight of the ketone compound, and from about 20 up to about 50 percent by weight of the second polar aprotic solvent.

Fourth Exemplary Composition for Removing Photoresist

A fourth composition for removing photoresist will be fully described hereinafter. The fourth composition for removing photoresist includes a first polar aprotic solvent having at least one of an ether compound and an ester compound and a second polar aprotic solvent having at least one of an ether compound and an ester compound. The first polar aprotic solvent and the second polar aprotic solvent are previously described so that detailed descriptions will be omitted.

When the fourth composition includes less than about 10 percent by weight of the first polar aprotic solvent and greater than about 90 percent by weight of the second polar aprotic solvent, the fourth composition may not sufficiently dissolve the detached photoresist. In addition, when the content of the first polar aprotic solvent is greater than about 80 percent by weight and the content of the second polar aprotic solvent is less than about 20 percent by weight, the detached photoresist may be readsorbed onto the substrate to generate process failures in subsequent processes. Thus, the fourth composition of the present invention may preferably include from about 10 up to about 80 percent by weight of the first polar aprotic solvent and from about 20 up to about 90 percent by weight of the second polar aprotic solvent, and more preferably, from about 10 up to about 50 percent by weight of the first polar aprotic solvent and from about 50 up to about 90 percent by weight of the second polar aprotic solvent.

Exemplary Method of Removing Photoresist

A method of removing photoresist using the first to the fourth compositions according to an embodiment of the present invention will be fully described hereinafter.

In the method of removing the photoresist according to an embodiment of the present invention, the first composition for removing photoresist is prepared. The first composition includes the ketone compound, the first polar aprotic solvent having at least one of an ether compound and an ester compound, and the second polar aprotic solvent having at least one of a sulfur-containing compound and a nitrogen-containing compound. The first composition may preferably include from about 20 up to about 50 percent by weight of the ketone compound, from about 40 up to about 70 percent by weight of the first polar aprotic solvent, and from about 10 up to about 40 percent by weight of the second polar aprotic solvent, and more preferably, from about 20 up to about 40 percent by weight of the ketone compound, from about 40 up to about 60 percent by weight of the first polar aprotic solvent, and from about 20 up to about 40 percent by weight of the second polar aprotic solvent.

In the method of removing the photoresist according to another embodiment of the present invention, the second composition for removing photoresist may be used instead of the first composition. The second composition includes the ketone compound and the first polar aprotic solvent having at least one of an ether compound and an ester compound. The method of removing the photoresist using the second composition is substantially identical to that of the first composition. The second composition may preferably include from about 20 up to about 80 percent by weight of the ketone compound and from about 20 up to about 80 percent by weight of the first polar aprotic solvent, and more preferably, from about 50 up to about 80 percent by weight of the ketone compound and from about 20 up to about 50 percent by weight of the first polar aprotic solvent.

In the method of removing the photoresist according to yet another embodiment of the present invention, the third composition for removing photoresist may be used instead of the first composition. The third composition includes the ketone compound and the second polar aprotic solvent having at least one of a sulfur-containing compound and a nitrogen-containing compound. The method of removing the photoresist using the third composition is substantially identical to that of the first composition. The third composition may preferably include from about 20 up to about 80 percent by weight of the ketone compound and from about 20 up to about 80 percent by weight of the second polar aprotic solvent, and more preferably, from about 50 up to about 80 percent by weight of the ketone compound and from about 20 up to about 50 percent by weight of the second polar aprotic solvent.

In the method of removing the photoresist according to still another embodiment of the present invention, the fourth composition for removing photoresist may be used instead of the first composition. The fourth composition includes the first polar aprotic solvent having at least one of an ether compound and an ester compound, and the second polar aprotic solvent having at least one of a sulfur-containing compound and a nitrogen-containing compound. The method of removing the photoresist using the fourth composition is substantially identical to that of the first composition. The fourth composition may preferably include from about 10 up to about 80 percent by weight of the first polar aprotic solvent and from about 20 up to about 90 percent by weight of the second polar aprotic solvent, and more preferably, from about 10 up to about 50 percent by weight of the first polar aprotic solvent and from about 50 up to about 90 percent by weight of the second polar aprotic solvent.

After the first composition for removing photoresist is prepared, the photoresist is removed from an object by contacting the first composition with the photoresist on the object. The photoresist may include a novolac resin, because the first composition can effectively remove novolac-based photoresist.

The photoresist may be removed using a batch-type cleaning apparatus or a single-type cleaning apparatus. When the photoresist is removed using the batch-type cleaning apparatus, the photoresist may be immersed in the first composition for a predetermined time period, for example, from about 5 minutes up to about 20 minutes. When the photoresist is removed using the single-type cleaning apparatus, the photoresist may be contacted with the composition for a predetermined time period, for example, from about 30 seconds up to about 5 minutes. The process time for contacting the photoresist with the first composition may be adjusted in accordance with an amount of photoresist residues, characteristics of an underlying layer of the photoresist, or types of etching residues.

When the temperature of the first composition is lower than about 10° C., a process time needed for removing the photoresist may become excessively longer. When the temperature of the first composition is higher than about 45° C., the photoresist may be rapidly removed, but a structure formed on the object such as a substrate may be unpreferably damaged. Examples of the structure may include various elements of a CMOS image sensor. Thus, the first composition of the present invention may preferably have a temperature of from about 10 up to about 45° C.

Exemplary Method of Manufacturing a Semiconductor Device

A method of manufacturing a semiconductor device using the composition for removing photoresist according to some embodiments of the present invention will be fully described hereinafter with reference to the accompanying drawings.

FIGS. 1 to 4 are cross-sectional views illustrating a method of manufacturing a semiconductor device in accordance with an example embodiment of the present invention.

Figure 2:
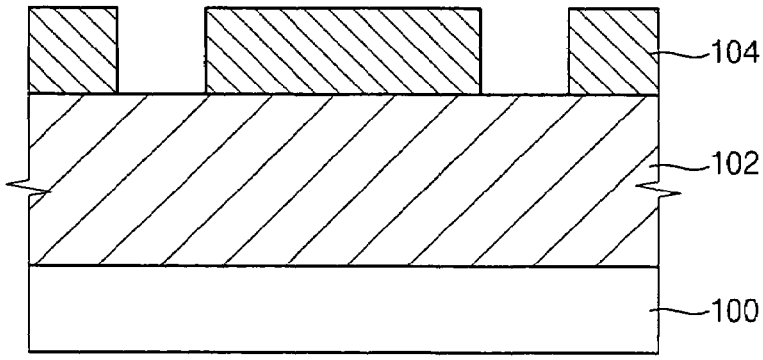

FIG. 1 is a cross-sectional view illustrating a structure 102 formed on a substrate 100. FIG. 2 is a cross-sectional view illustrating the formation of a photoresist pattern 104 on the structure 102.

Referring to FIGS. 1 and 2, the structure 102 is formed on the substrate 100. The photoresist pattern 104 is formed on the substrate 100 to expose a portion of the structure 102. Particularly, a photoresist film is formed on the structure 102. The photoresist film is capable of being formed using a novolac resin. The photoresist film is exposed to light through a mask and developed to form the photoresist pattern 104 on the structure 102.

Figure 3:
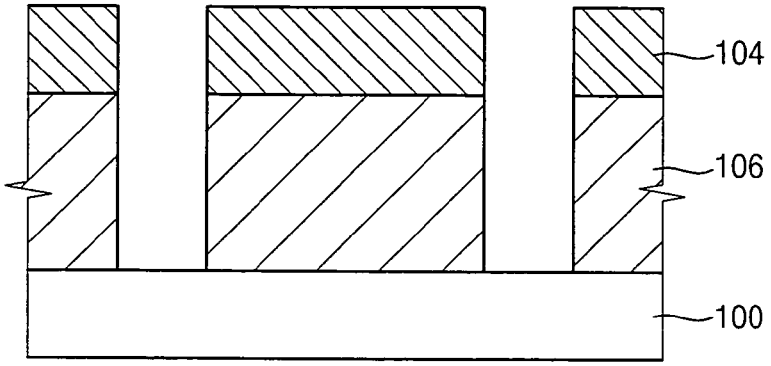

FIG. 3 is a cross-sectional view illustrating the formation of a structure pattern 106.

Referring to FIG. 3, the exposed portion of the structure 102 is removed using the photoresist pattern 104 as an etching mask to form the structure pattern 106 on the substrate 100.

Figure 4:
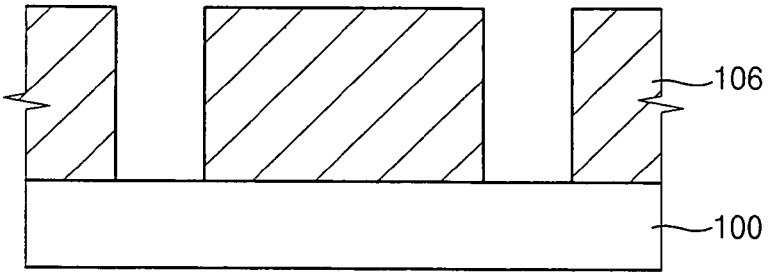

FIG. 4 is a cross-sectional view illustrating a step of removing the photoresist pattern 104.

Referring to FIG. 4, the photoresist pattern 104 is removed from the substrate 100. The photoresist pattern 104 is removed using the first composition for removing photoresist. The first composition can include a ketone compound, a first polar aprotic solvent particularly one having at least one of an ether compound and an ester compound. It can also include a second polar aprotic solvent particularly one having at least one of a sulfur-containing compound and a nitrogen-containing compound. The first composition may preferably include from about 20 up to about 50 percent by weight of the ketone compound, from about 40 up to about 70 percent by weight of the first polar aprotic solvent, and from about 10 up to about 40 percent by weight of the second polar aprotic solvent, and more preferably, from about 20 up to about 40 percent by weight of the ketone compound, from about 40 up to about 60 percent by weight of the first polar aprotic solvent, and from about 20 up to about 40 percent by weight of the second polar aprotic solvent.

When the photoresist pattern 104 is removed, impurities may be simultaneously removed from the substrate 100. The impurities may include an organic polymer, an oxide polymer, a metallic polymer or a mixture thereof.

In the method of manufacturing a semiconductor device according to an embodiment of the present invention, the second composition for removing photoresist may be used instead of the first composition. The second composition can include the ketone compound and the first polar aprotic solvent which can comprise at least one of an ether compound and an ester compound. The second composition may preferably include from about 20 up to about 80 percent by weight of the ketone compound and from about 20 up to about 80 percent by weight of the first polar aprotic solvent, and more preferably, from about 50 up to about 80 percent by weight of the ketone compound and from about 20 up to about 50 percent by weight of the first polar aprotic solvent.

In the method of manufacturing a semiconductor device according to another embodiment of the present invention, the third composition for removing photoresist may be used instead of the first composition. The third composition can include the ketone compound and the second polar aprotic solvent having at least one of a sulfur-containing compound and a nitrogen-containing compound. The third composition may preferably include from about 20 up to about 80 percent by weight of the ketone compound and from about 20 up to about 80 percent by weight of the second polar aprotic solvent, and more preferably, from about 50 up to about 80 percent by weight of the ketone compound and from about 20 up to about 50 percent by weight of the second polar aprotic solvent.

In the method of manufacturing a semiconductor device according to still another embodiment of the present invention, the fourth composition for removing photoresist may be used instead of the first composition. The fourth composition includes the first polar aprotic solvent having at least one of an ether compound and an ester compound and the second polar aprotic solvent having at least one of a sulfur-containing compound and a nitrogen-containing compound. The fourth composition may preferably include from about 10 up to about 80 percent by weight of the first polar aprotic solvent and from about 20 up to about 90 percent by weight of the second polar aprotic solvent, and more preferably, about from 10 up to about 50 percent by weight of the first polar aprotic solvent and from about 50 up to about 90 percent by weight of the second polar aprotic solvent.

Additionally, after removing the photoresist pattern 104, the substrate 100 may be rinsed using deionized water to remove remaining composition from the substrate 100. The impurities and photoresist residuals may be simultaneously removed from the substrate 100 in the rinsing process. The deionized water may be removed from the substrate 100 through a drying process. The semiconductor device of the present invention may be finished by performing ordinary processes.

In accordance with an example embodiment of the present invention, a method of manufacturing a CMOS (complementary metal oxide semiconductor) image sensor using the composition for removing photoresist will be fully described hereinafter with reference to the accompanying drawings.

FIGS. 5 to 16 are cross-sectional views illustrating a method of manufacturing a CMOS image sensor in accordance with an example embodiment of the present invention.

Figure 5:
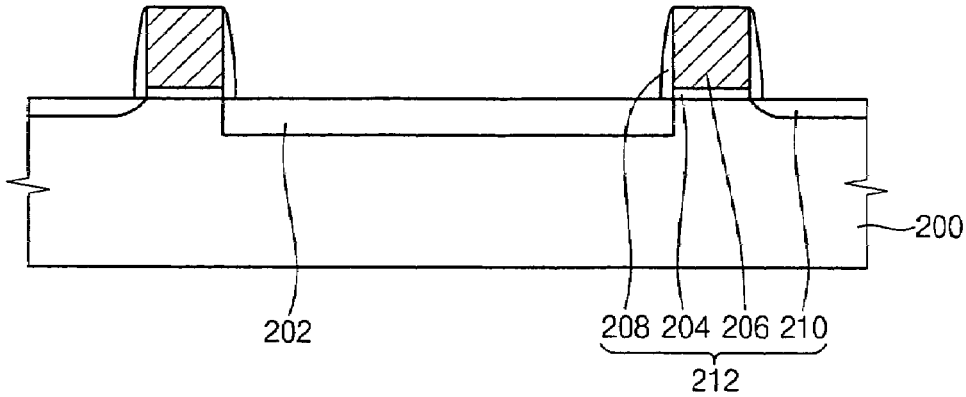
FIGS. 5 to 16 are cross-sectional views illustrating a method of manufacturing a semiconductor device in accordance with a further embodiment of the present invention.

FIG. 5 is a cross-sectional view illustrating the formation of a photodiode 202 and a transistor 212 formed on a substrate 200.

Referring to FIG. 5, an isolation layer (not shown) is formed on the substrate 200 to define an active region (not shown) and a field region (not shown). Photodiode 202, a light-receiving element, is formed on the active region of the substrate 200. The transistor 212 that is connected with the photodiode 202 is formed on the substrate 200. The transistor 212 may serve as a switching element of the photodiode 202. The transistor 212 includes a gate insulation layer 204, a gate electrode 206, a source/drain region 210 and spacers 208. Particularly, after the gate insulation layer 204 is formed on the substrate 200, the gate electrode 206 is formed on the gate insulation layer 204. Impurities are implanted into an upper portion of the substrate 200 between the gate electrodes 206 to form the source/drain region 210. The spacers 208 are formed on sidewalls of the gate electrode 206 to finish the transistor 212. The transistor 212 includes the gate insulation layer 204, the gate electrode 206, the source/drain region 210 and the spacers 208.

Figure 6:
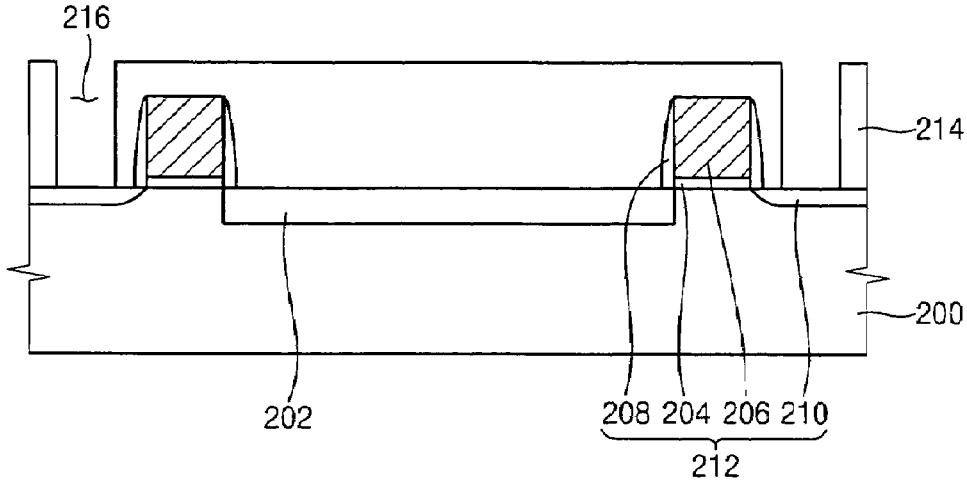

FIG. 6 is a cross-sectional view illustrating the formation of an insulation layer 214 on the substrate 200.

Referring to FIG. 6, the insulation layer 214 is formed on the substrate 200 to cover the transistor 212. The insulation layer 214 may be formed using a transparent material. Examples of the transparent material may include silicon oxide, etc. The insulation layer 214 is partially etched through a photolithography process to form a first contact hole 216 that exposes a portion of the transistor 212.

Figure 7:
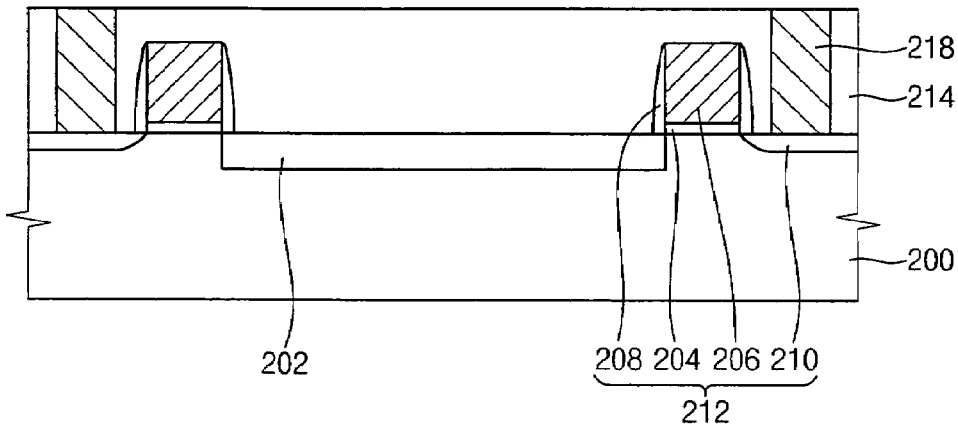

FIG. 7 is a cross-sectional view illustrating the formation of a first metal pad 218 on the substrate 200.

Referring to FIG. 7, a first metal layer is formed to fill up the first contact hole 216. The first metal layer may be formed using a metal such as titanium, tungsten, copper, etc. For example, the first metal layer may be formed using a chemical vapor deposition (CVD) process or a sputtering process. When the first metal layer is formed using a material including copper, copper may be diffused into the silicon wafer. Therefore, the first metal layer may be advantageously formed using a material including titanium or tungsten.

The first metal layer may be partially removed using a chemical mechanical polishing (CMP) process until a surface of the insulation layer 214 is exposed. Thus, the first metal pad 218 is formed on the substrate 200 to fill the first contact hole 216.

Figure 8:
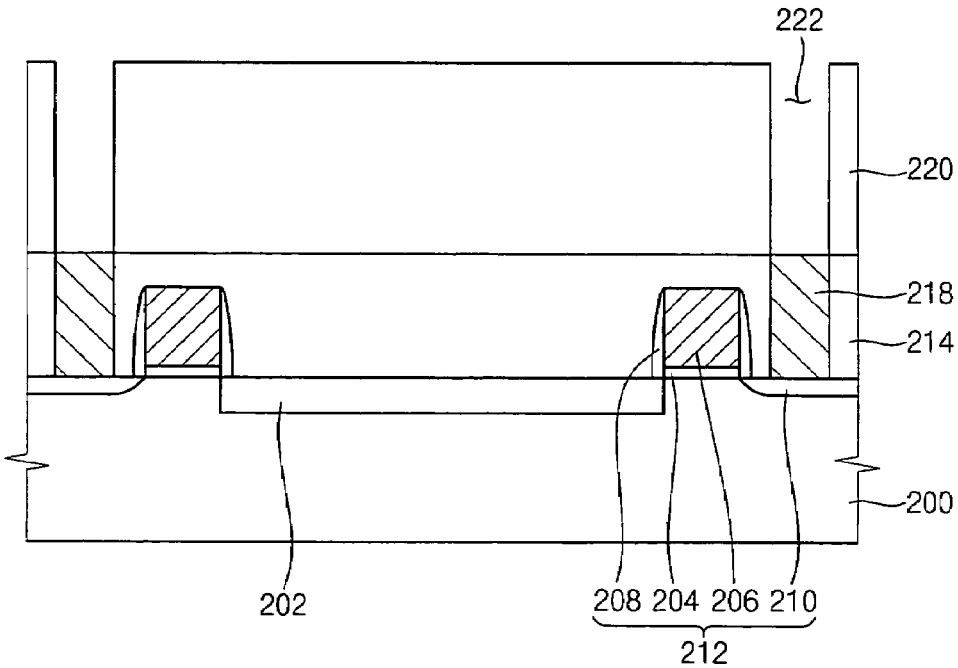

FIG. 8 is a cross-sectional view illustrating the formation of an insulation interlayer 220 on the insulation layer 214 and the first metal pad 218.

Referring to FIG. 8, the insulation interlayer 220 is formed on the insulation layer 214 and the first metal pad 218. The insulation interlayer 220 may be formed using a transparent material such as silicon oxide. The insulation interlayer 220 is partially etched through a photolithography process to form a second contact hole 222 that exposes the first metal pad 218.

Figure 9:
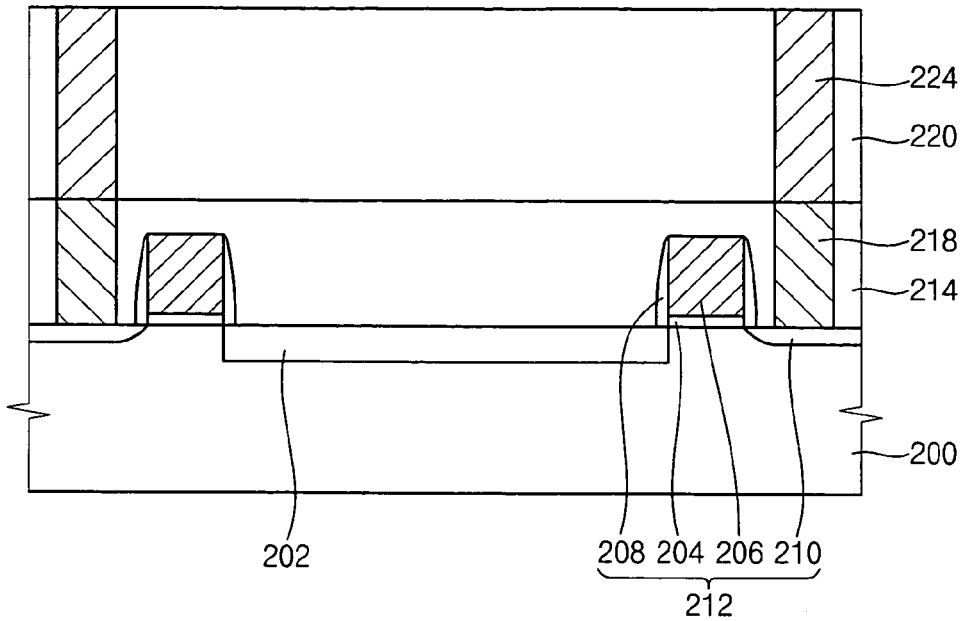

FIG. 9 is a cross-sectional view illustrating the formation of a second metal pad 224 on the first metal pad 218.

Referring to FIG. 9, a second metal layer is formed on the insulation interlayer 220 and the first metal pad 218 to fill the second contact hole 222. The second metal layer may be formed using a metal such as titanium, tungsten, copper, etc. For example, the second metal layer may be formed using a chemical vapor deposition process or a sputtering process. The second metal layer may be partially removed using a chemical mechanical polishing process until a surface of the insulation interlayer 220 is exposed. Thus, the second metal pad 224 is formed on the first metal pad 218 to fill the second contact hole 222. Accordingly, an insulation interlayer structure including the insulation interlayer 220 and the second metal pad 224 is formed.

Figure 10:
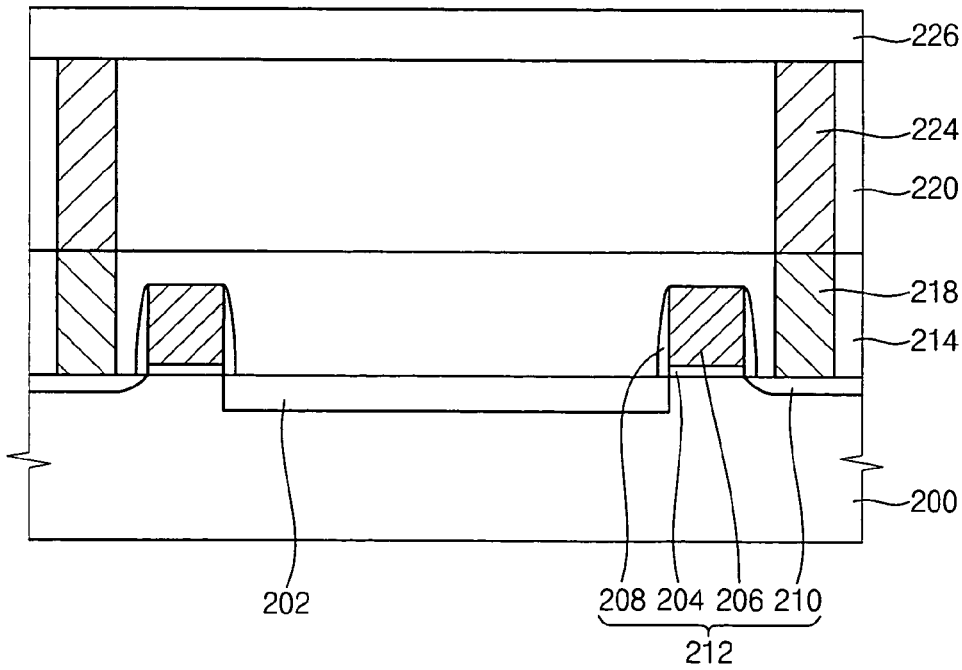

FIG. 10 is a cross-sectional view illustrating the formation of a first photosensitive film 226 on the insulation interlayer 220 and the second metal pad 224.

Referring to FIG. 10, the first photosensitive film 226 is formed on the insulation interlayer 220 and the second metal pad 224. The first photosensitive film 226 may protect various underlying elements from moisture or scratches. The first photosensitive film 226 may include a photosensitive material such as a photoresist.

Figure 11:
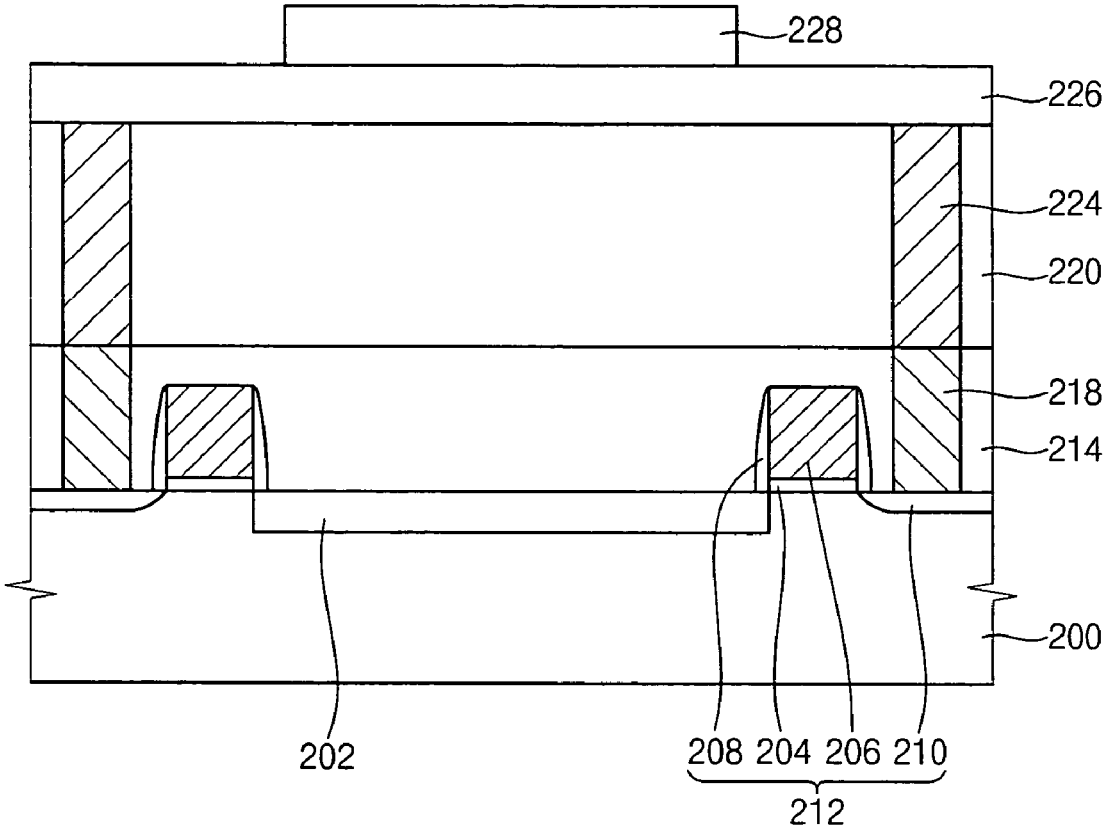

FIG. 11 is a cross-sectional view illustrating the formation of a color filter 228 on the first photosensitive film 226.

Referring to FIG. 11, the color filter 228 is formed on the first photosensitive film 226. The color filter 228 may have an array structure of red, green and blue color filters. For example, one color filter of the red, green and blue color filters is formed on the photodiode 202, which is a light-receiving element. The color filter 228 may include a photosensitive material such as photoresist. Examples of the photoresist used for forming the color filter 228 may include a methacrylic resin, a cross-linked methacrylic resin, etc. The color filter 228 may have a stepped portion.

Figure 12:
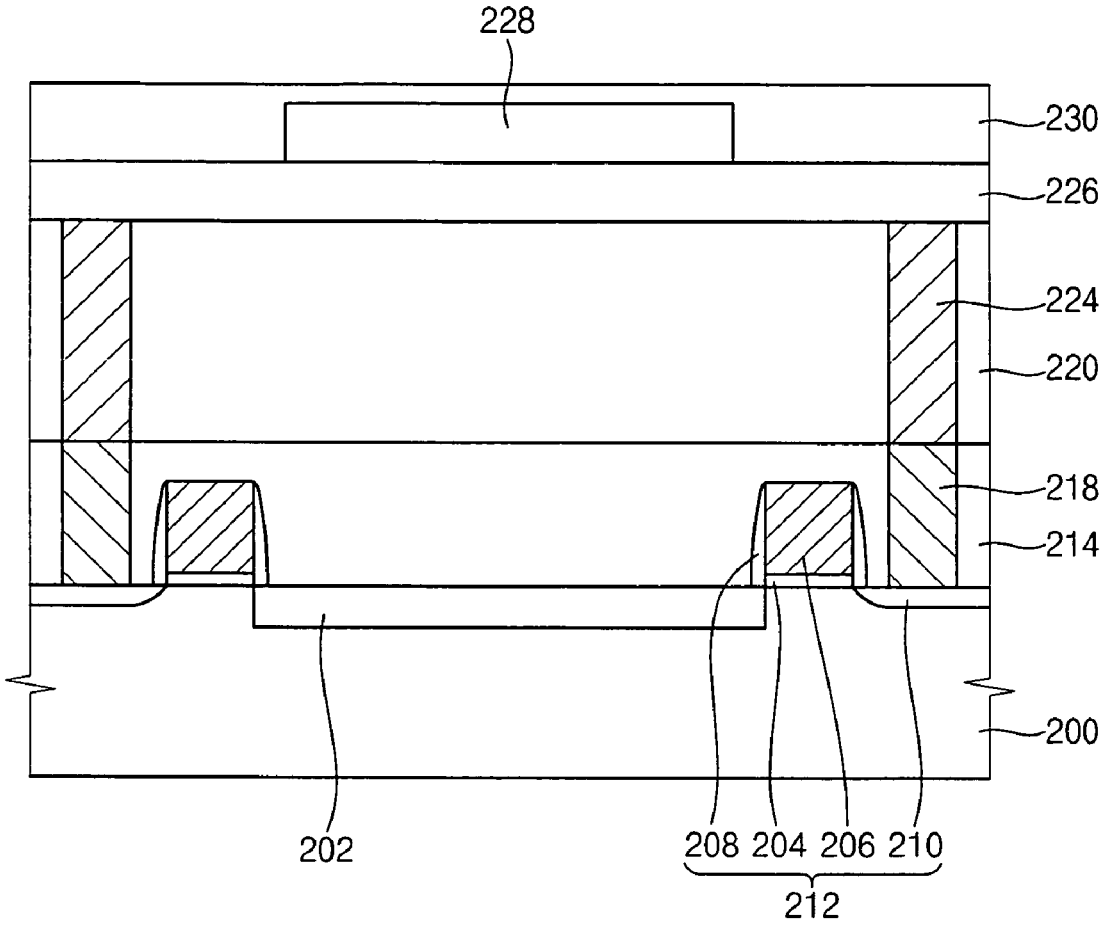

FIG. 12 is a cross-sectional view illustrating the formation of a second photosensitive film 230 on the color filter 228.

Referring to FIG. 12, the second photosensitive film 230 is formed on the first photosensitive film 226 and the color filter 228. When the color filter has a stepped portion, the second photosensitive film 230 may overcome problems induced by the stepped portion of the color filter. For example, a microlens 232 (see FIG. 13) may not be formed on an underlying layer including a stepped portion in a subsequent process. The second photosensitive film 230 may exclude the stepped portion of the color filter as being the underlying layer of the microlens 232. The second photosensitive film 230 may include a photosensitive material such as photoresist. The first photosensitive film 226 and the second photosensitive film 230 may or may not include the same type of photoresist.

Figure 13:
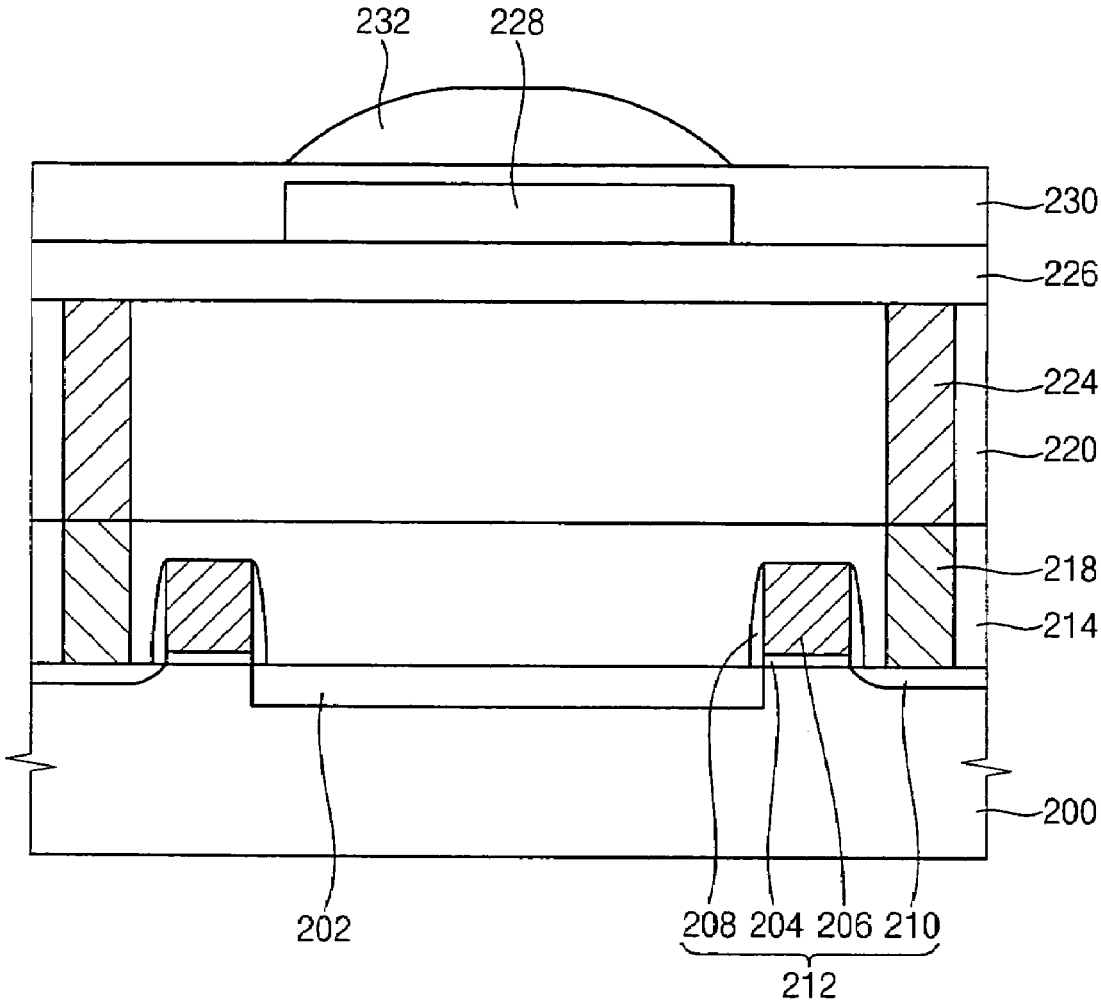

FIG. 13 is a cross-sectional view illustrating the formation of the microlens 232 over the color filter 228.

Referring to FIG. 13, the microlens 232 is formed over the color filter 228. The microlens 232 may collect light to provide the light to the photodiode 202 formed below the microlens 232. The microlens 232 may have a convex upper surface.

Figure 14:
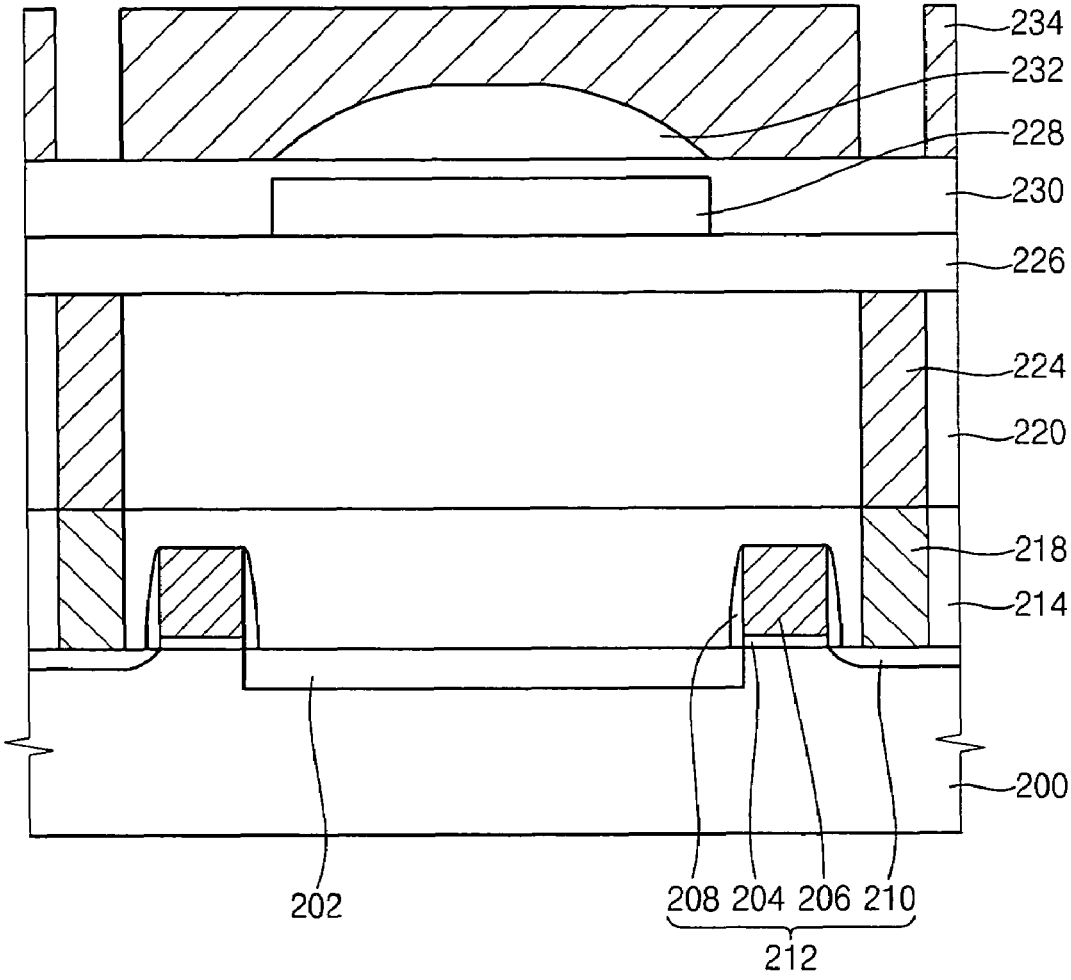

FIG. 14 is a cross-sectional view illustrating the formation of a photoresist pattern 234 on the microlens 232 and the second photosensitive film 230.

Referring to FIG. 14, a photoresist film is formed on the microlens 232 and the second photosensitive film 230. The photoresist film may preferably include novolac resin. The photoresist film is partially removed using a photolithography process to form the photoresist pattern 234. The photoresist pattern 234 may expose a portion of the second photosensitive film that is formed over the first metal pad 218 and the second metal pad 224.

Figure 15:
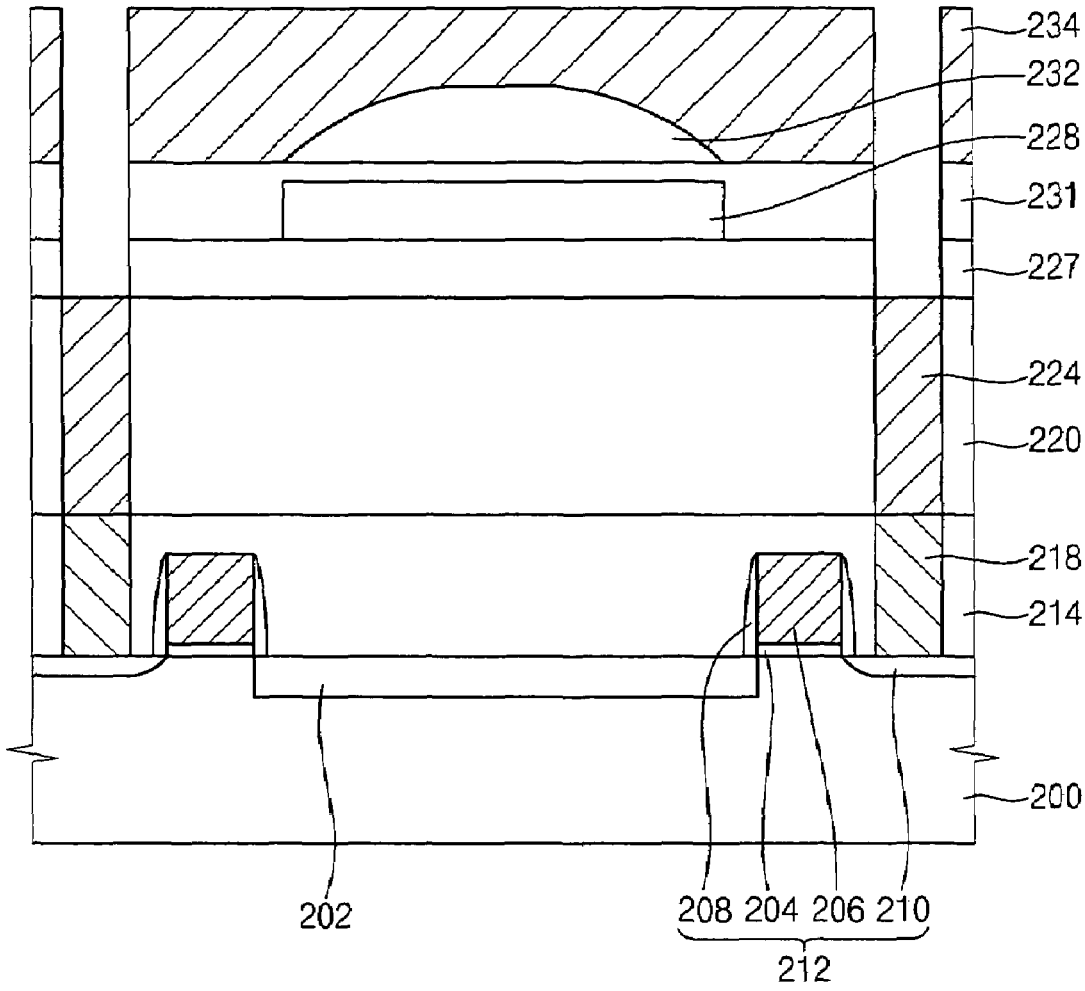

FIG. 15 is a cross-sectional view illustrating the formation of a first photosensitive pattern 227 on the insulation interlayer 220 and a second photosensitive pattern 231 on the first photosensitive pattern 227.

Referring to FIG. 15, the second photosensitive film 230 and the first photosensitive film 226 are successively etched using the photoresist pattern 234 as an etching mask to form the second photosensitive pattern 231 and the first photosensitive pattern 227, respectively. Thus, the second metal pad 224 formed in the insulation interlayer 220 may be exposed.

Figure 16:
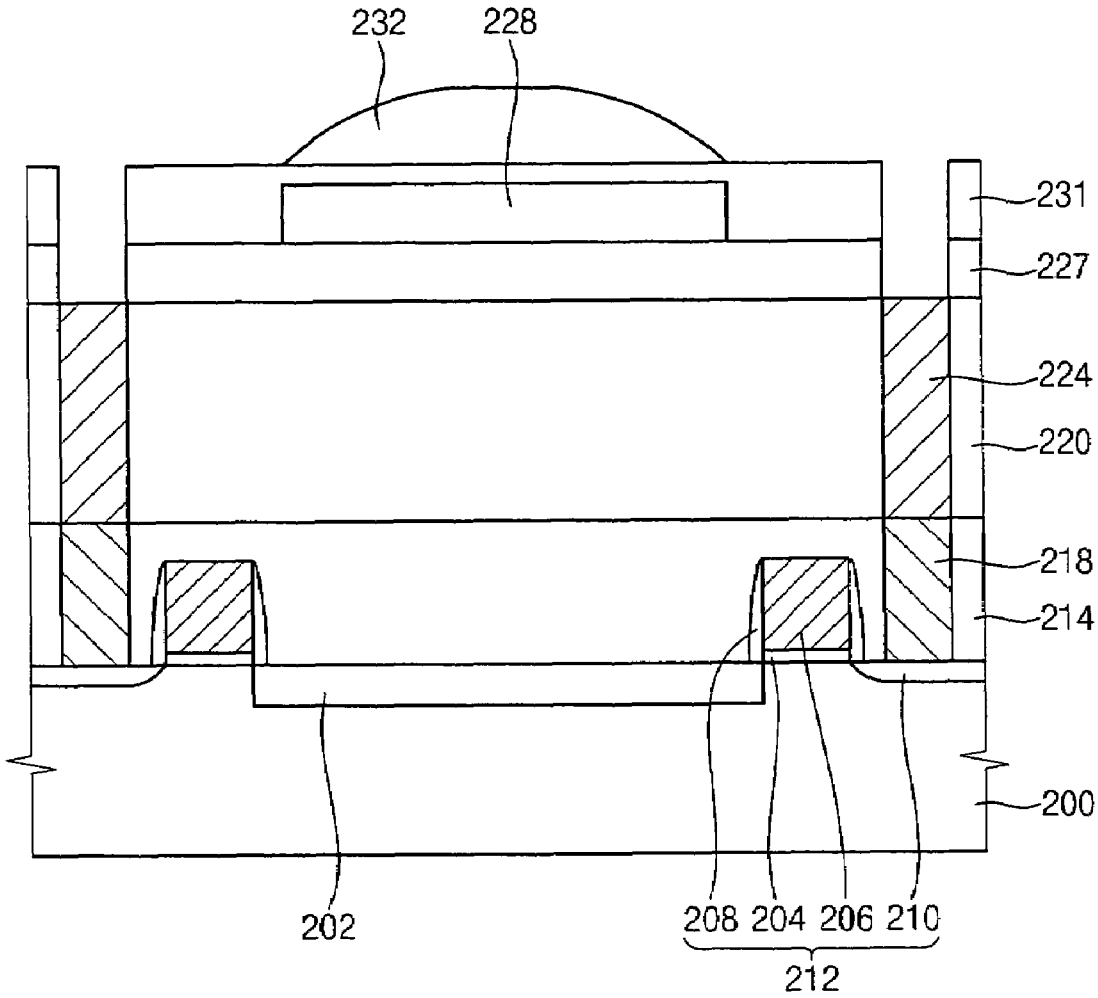

FIG. 16 is a cross-sectional view illustrating a step of removing the photoresist pattern 234.

Referring to FIG. 16, the photoresist pattern 234 is removed from the substrate 200 using the first composition for removing photoresist. The first composition includes, for example, the ketone compound, the first polar aprotic solvent having at least one of an ether compound and an ester compound, and the second polar aprotic solvent having at least one of a sulfur-containing compound and a nitrogen-containing compound. The first composition may preferably include about from 20 up to about 50 percent by weight of the ketone compound, from about 40 up to about 70 percent by weight of the first polar aprotic solvent, and from about 10 up to about 40 percent by weight of the second polar aprotic solvent, and more preferably, from about 20 up to about 40 percent by weight of the ketone compound, from about 40 up to about 60 percent by weight of the first polar aprotic solvent, and from about 20 up to about 40 percent by weight of the second polar aprotic solvent.

When the photoresist pattern 234 is removed, impurities may be simultaneously removed from the substrate 200. The impurities may include an organic polymer, an oxide polymer, a metallic polymer or a mixture thereof.

In the method of manufacturing a CMOS image sensor of a semiconductor device in accordance with an example embodiment of the present invention, the second composition for removing photoresist may be used instead of the first composition. The second composition includes the ketone compound and the first polar aprotic solvent having at least one of an ether compound and an ester compound. The second composition may preferably include from about 20 up to about 80 percent by weight of the ketone compound and from about 20 up to about 80 percent by weight of the first polar aprotic solvent, and more preferably, from about 50 up to about 80 percent by weight of the ketone compound and from about 20 up to about 50 percent by weight of the first polar aprotic solvent.

In the method of manufacturing a CMOS image sensor of a semiconductor device in accordance with an example embodiment of the present invention, the third composition for removing photoresist may be used instead of the first composition. The third composition may include the ketone compound and the second polar aprotic solvent having at least one of a sulfur-containing compound and a nitrogen-containing compound. The third composition may preferably include from about 20 up to about 80 percent by weight of the ketone compound and from about 20 up to about 80 percent by weight of the second polar aprotic solvent, and more preferably, from about 50 up to about 80 percent by weight of the ketone compound and from about 20 up to about 50 percent by weight of the second polar aprotic solvent.

In the method of manufacturing a CMOS image sensor of a semiconductor device in accordance with an example embodiment of the present invention, the fourth composition for removing photoresist may be used instead of the first composition. The fourth composition includes the first polar aprotic solvent having at least one of an ether compound and an ester compound and the second polar aprotic solvent having at least one of a sulfur-containing compound and a nitrogen-containing compound. The fourth composition may preferably include from about 10 up to about 80 percent by weight of the first polar aprotic solvent and from about 20 up to about 90 percent by weight of the second polar aprotic solvent, and more preferably, about from 10 up to about 50 percent by weight of the first polar aprotic solvent and from about 50 up to about 90 percent by weight of the second polar aprotic solvent.

Additionally, after removing the photoresist pattern 104, the substrate 100 may be rinsed using deionized water to remove remaining composition from the substrate 200. The impurities and photoresist residuals may be simultaneously removed from the substrate 200 in the rinsing process. The deionized water may be removed from the substrate 200 by a drying process. The CMOS image sensor of the present invention may be finished by performing ordinary processes.

A composition for removing photoresist according to some embodiments of the present invention will be further described hereinafter through Examples and Comparative Examples.

Preparation of a Composition for Removing Photoresist

Example 1

A composition for removing photoresist was prepared by mixing about 67 percent by weight of acetone and about 33 percent by weight of dimethylacetamide (DMAc), based on a total weight of the composition.

Example 2

A composition for removing photoresist was prepared by mixing about 80 percent by weight of ethyl lactate (EL) and about 20 percent by weight of dimethylacetamide (DMAc), based on a total weight of the composition.

Example 3

A composition for removing photoresist was prepared by mixing about 20 percent by weight of propylene glycol methyl ether acetate (PGMEA) and about 80 percent by weight of dimethylacetamide (DMAc), based on a total weight of the composition.

Example 4

A composition for removing photoresist was prepared by mixing about 80 percent by weight of methyl isobutylketone (MIBK) and about 20 percent by weight of N-methyl-2-pyrrolidinone (NMP), based on a total weight of the composition.

Example 5

A composition for removing photoresist was prepared by mixing about 60 percent by weight of ethyl lactate (EL), about 20 percent by weight of dimethylacetamide (DMAc) and about 20 percent by weight of acetone, based on a total weight of the composition.

Example 6

A composition for removing photoresist was prepared by mixing about 40 percent by weight of propylene glycol methyl ether acetate (PGMEA), about 20 percent by weight of dimethylacetamide (DMAc) and about 40 percent by weight of acetone, based on a total weight of the composition.

Comparative Examples 1 to 3

In Comparative Examples 1 to 3, each of the compositions including acetone, ethyl lactate (EL) or dimethylacetamide (DMAc) respectively was prepared. Particularly, the composition of Comparative Examples 1 included about 100 percent by weight of acetone, the composition of Comparative Examples 2 included about 100 percent by weight of ethyl lactate (EL), and the composition of Comparative Examples 3 included about 100 percent by weight of dimethylacetamide (DMAc).

Components and contents of the composition according to Examples and Comparative Examples are shown in the following Table 1.

TABLE 1

| | Ketone Compound [wt %] | | First Polar Aprotic Solvent [wt %] | | Second Polar Aprotic Solvent [wt %] | |
|---|---|---|---|---|---|---|
| Example 1 | Acetone | 67 | | | DMAc | 33 |
| Example 2 | | | EL | 80 | DMAc | 20 |
| Example 3 | | | PGMEA | 20 | DMAc | 80 |
| Example 4 | MIBK | 80 | | | NMP | 20 |
| Example 5 | Acetone | 20 | EL | 60 | DMAc | 20 |
| Example 6 | Acetone | 40 | PGMEA | 40 | DMAc | 20 |
| Comparative Example 1 | Acetone | 100 | | | | |
| Comparative Example 2 | | | EL | 100 | | |
| Comparative Example 3 | | | | | DMAc | 100 |

Estimation of Cleaning Abilities of Compositions for Removing Photoresist

Cleaning abilities for removing novolac-based photoresist were estimated using the compositions prepared in Examples 1 to 6 and Comparative Examples 1 to 3.

In order to estimate cleaning abilities of compositions for removing photoresist, a photoresist film was formed on a silicon wafer having a size of about 2 cm×about 2 cm. The photoresist film having a thickness of about 12,000 Å was formed using a novolac resin. AZ9260 (trade name; manufactured by Clariant Ltd., Japan) was used as the novolac resin. The photoresist film was partially removed through a photolithography process. After an exposure process and a development process were performed for the photoresist film, a plasma etching process and an $O_2$ gas treatment process were performed with respect to the silicon wafer on which the photoresist film was formed. The photoresist film was denatured in the development process and the plasma etching process.

Each of the compositions prepared in Examples 1 to 6 and Comparative Examples 1 to 3 was poured into a 300 mL beaker. The wafer including the photoresist film thereon was immersed in each of the compositions for about three minutes. The temperature of the compositions was maintained at a room temperature. Subsequently, the wafer was immersed in deionized water for about one minute so that each of the compositions was removed from the wafer. The wafer was dried using $N_2$ gas.

The process time needed for removing the photoresist film was measured by observing disappearance of the color of the photoresist. When the photoresist film was detached from the wafer, the color of the photoresist disappeared. Thus, a photoresist removal rate relative to the compositions may be estimated by observing the disappearance of the color of the photoresist. When the color of the photoresist disappears in a relatively short time, the composition effectively permeates into the photoresist film to detach the photoresist film rapidly from the wafer. In addition, the number of particles on the wafer was measured using particle inspection equipment in order to estimate remaining impurities on the wafer. The AWIS-FIT 3110 (trade name; manufactured by ADE Co., U.S.A.) was used as the particle inspection equipment. The number of particles having a radius greater than about 0.3 μm was counted using the particle inspection equipment. The photoresist removabilities of the compositions may be estimated from the number of particles. As the number of particles decreases, the amount of the remaining photoresist becomes smaller. The small amount of the remaining photoresist means that the composition may have an excellent removability for the photoresist film.

In determining the cleaning ability of the composition, some factors may be considered. The composition for removing photoresist may be required to permeate into the photoresist to detach the photoresist from the wafer rapidly. The composition for removing photoresist may be required to leave few residual impurities on the substrate after the photoresist removal process that includes rinsing and drying the substrate. When the detached photoresist is not dissolved in the composition, the detached photoresist may be readsorbed onto the wafer to form residual impurities.

The cleaning ability of the compositions prepared in the Examples 1 to 6 and Comparative Examples 1 to 3 are shown in the following Table 2.

TABLE 2

| | Removal Time [sec] | Number of Particles [> about 0.3 μm] |
|---|---|---|
| Example 1 | 1 | 335 |
| Example 2 | 15 | 123 |
| Example 3 | 1 | 140 |
| Example 4 | 11 | 933 |
| Example 5 | 8 | 311 |
| Example 6 | 12 | 1,110 |
| Comparative Example 1 | 15 | 4,976 |
| Comparative Example 2 | 32 | 3,700 |
| Comparative Example 3 | 1 | 1,867 |

Referring to Table 2, the compositions prepared in Examples 1 to 6 according to an aspect of the present invention rapidly removed photoresist compared with the compositions prepared in Comparative Examples 1 to 3. Furthermore, the compositions prepared in Examples 1 to 6 according to an embodiment of the present invention left fewer residual impurities than those of the compositions prepared in Comparative Examples 1 to 3.

Particularly, the composition prepared in Example 1 detached the photoresist from the wafer in about one second. The composition including acetone and dimethylacetamide (DMAc) according to Example 1 detached the photoresist more rapidly than the composition including only acetone according to Comparative Example 1.

The composition prepared in Comparative Example 3 rapidly detached the photoresist in about one second. However, the composition did not dissolve the detached photoresist, so that the detached photoresist was readsorbed onto the wafer to form a relatively large amount of residual particles.

Figure 17:
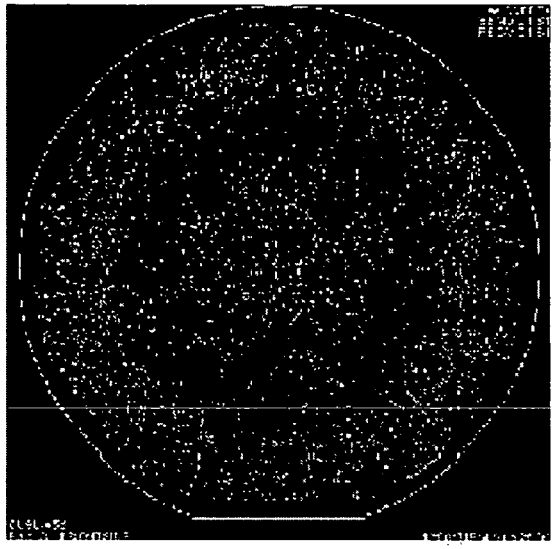
FIGS. 17 and 18 are pictorial illustrations of a surface of a wafer after removing photoresist from the wafer using the compositions prepared in Example 1 and Comparative Example 1.
Figure 18:
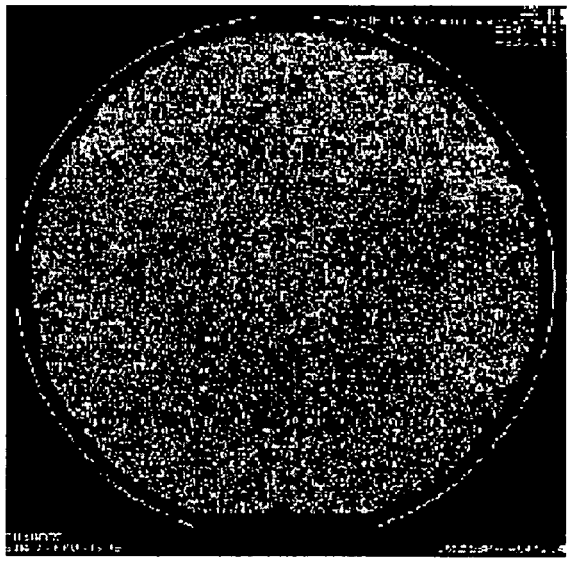

FIGS. 17 and 18 are pictures illustrating a surface of the wafer after removing photoresist from the wafer using the compositions in accordance with Example 1 and Comparative Example 1. FIG. 17 is a picture illustrating the surface of the wafer after removing the photoresist using the composition prepared in Example 1, and FIG. 18 is a picture illustrating the surface of the wafer after removing the photoresist using the composition prepared in Comparative Example 1.

Referring to Table 2, FIG. 17 and FIG. 18, when the photoresist was removed using the composition prepared in Comparative Example 1, residual particles remained on the wafer in a number of about 5,000 and the particles were distributed over the entire surface of the wafer. However, when the photoresist was removed using the compositions prepared in Examples 1 to 6, residual particles remained on the wafer in a number of about 100 to about 1,000 and the number of residual particles was remarkably reduced. Therefore, the composition for removing photoresist according to an embodiment of the present invention may have an enhanced cleaning ability.

Estimation of Selective Cleaning Ability of Composition

Selective cleaning ability for a particular photoresist was estimated using the compositions prepared in Examples 1 to 6 and Comparative Examples 1 to 3.

In order to determine the selective cleaning ability of a composition, three types of photoresist films were formed on each of three silicon wafers having a size of about 2 cm×about 2 cm. Each of the photoresist films had a thickness of about 12,000 Å. The three types of the photoresist films were formed using novolac resin, methacryl resin and cross-linked methacryl resin, respectively. AZ9260 (trade name; manufactured by Clariant Ltd., Japan) was used as the novolac resin.

Each of the compositions prepared in Examples 1 to 6 and Comparative Examples 1 to 3 was poured into a 300 mL beaker. The wafers respectively including a novolac-based photoresist film, a methacryl-based photoresist film and a cross-linked methacryl-based photoresist film thereon were immersed in each of the compositions. The temperature of the compositions was maintained at a room temperature. The wafer including the novolac-based photoresist film thereon was immersed in the compositions for about three minutes, and then photoresist residuals were observed with the naked eye. For the wafer including the methacryl-based photoresist film thereon, and the wafer including the cross-linked methacryl-based photoresist film thereon, etch rates of the photoresist films were measured by observing a thickness change of the photoresist film relative to the immersing time. Selective cleaning abilities of the compositions with respect to types of photoresist are shown in the following Table 3. In the following Table 3, "O" represents a lot of photoresist residuals, "Δ" represents a relatively small amount of photoresist residuals, and "X" represents little or no photoresist residuals.

TABLE 3

| | Novolac-based Photoresist Residuals | Methacryl-based Photoresist Etch Rate [Å/min] | Cross-linked Methacryl-based Photoresist Etch Rate [Å/min] |
|---|---|---|---|
| Example 1 | X | 12 | 0 |
| Example 2 | X | 5 | 12 |
| Example 3 | X | 4 | 12 |
| Example 4 | X | 0 | 0 |
| Example 5 | X | 7 | 12 |
| Example 6 | X | 11 | 8 |
| Comparative Example 1 | Δ | 22 | 0 |
| Comparative Example 2 | ○ | 5 | 10 |
| Comparative Example 3 | X | 6 | 7 |

Referring to Table 3, the novolac-based photoresist film having a thickness of about 12,000 Å was almost removed in about three minutes using the compositions prepared in Examples 1 to 6 and Comparative Example 3. For the compositions prepared in Examples 1 to 6 and Comparative Example 3, etch rates of the novolac-based photoresist film were all greater than about 4,000 Å/min. However, the compositions prepared in Comparative Examples 1 and 2 had photoresist residuals that remained on the wafer even after removing the novolac-based photoresist for about three minutes. Particularly, when the novolac-based photoresist film was removed using the composition prepared in Comparative Example 1, detached minute photoresist was readsorbed onto the wafer, due to high volatility of acetone in the composition, to form photoresist residuals. Therefore, the composition for removing the photoresist according to an embodiment of the present invention may prevent photoresist residuals from being readsorbed onto the wafer, and may overcome some problems of the conventional solution including ketone that has the high volatility.

The compositions prepared in Examples 1 to 6 rapidly removed the novolac-based photoresist film. However, the methacryl-based photoresist film and the cross-linked methacryl-based photoresist film were removed at relatively small etch rates or were almost not removed by the compositions prepared in Examples 1 to 6. The methacryl-based photoresist film and the cross-linked methacryl-based photoresist film were slowly removed at etch rates of about 0 to about 30 Å/min, but the novolac-based photoresist film was rapidly removed at etch rates of greater than or equal to about 4,000 Å/min. Therefore, the composition for removing photoresist according to an embodiment of the present invention may selectively remove novolac-based photoresist from the wafer including various types of photoresist thereon.

According to an aspect of the present invention, novolac-based photoresist may be selectively removed using a composition for removing photoresist. In a CMOS image sensor manufacturing process, the composition for removing photoresist may selectively remove the novolac-based photoresist from a substrate, and also may prevent a structure formed on the substrate from being damaged. Therefore, the composition for removing photoresist may effectively remove the photoresist pattern and prevent a defect generation of a semiconductor device, such as the CMOS image sensor, to enhance productivity in a semiconductor manufacturing process.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A method of removing photoresist comprising:

preparing a composition for removing photoresist, the composition including a ketone compound, a first polar aprotic solvent being at least one of an ether compound and an ester compound, and a second polar aprotic solvent being at least one of a sulfur-containing compound and a nitrogen-containing compound; and selectively removing a novolac-based photoresist from an object on which the novolac-based photoresist and a structure including an acryl-based resin are located by contacting the object with the composition while suppressing damage to the structure including the acryl-based resin.

2. The method of claim 1, wherein the composition for removing photoresist comprises, based on a total weight of the composition:

from about 20 to about 50 percent by weight of the ketone compound;

from about 40 to about 70 percent by weight of the first polar aprotic solvent; and from about 10 to about 40 percent by weight of the second polar aprotic solvent.

3. The method of claim 1, wherein the novolac-based photoresist is removed using a batch-type cleaning apparatus.

4. The method of claim 3, wherein the object is immersed in the composition for about 5 minutes up to about 20 minutes.

5. The method of claim 1, wherein the novolac-based photoresist is removed using a single-type cleaning apparatus.

6. The method of claim 5, wherein the object is contacted with the composition for from about 30 seconds up to about 5 minutes.

7. The method of claim 1, wherein the composition contacting the object has a temperature in a range of from about 10° C. up to about 45° C.

8. A method of removing photoresist comprising:

preparing a composition for removing photoresist, the composition including a ketone compound and a polar aprotic solvent being at least one of an ether compound and an ester compound; and selectively removing a novolac-based photoresist from an object on which the novolac-based photoresist and a structure including an acryl-based resin are located by contacting the object with the composition while suppressing damage to the structure including the acryl-based resin.

9. The method of claim 8, wherein the composition for removing photoresist comprises, based on a total weight of the composition:

from about 20 up to about 80 percent by weight of the ketone compound; and from about 20 up to about 80 percent by weight of the polar aprotic solvent.

10. A method of removing photoresist comprising:

preparing a composition for removing photoresist, the composition including a ketone compound and a polar aprotic solvent being at least one of a sulfur-containing compound and a nitrogen-containing compound; and selectively removing a novolac-based photoresist from an object on which the novolac-based photoresist and a structure including an acryl-based resin are located by contacting the object with the composition while suppressing damage to the structure including the acryl-based resin.

11. The method of claim 10, wherein the composition for removing photoresist comprises, based on a total weight of the composition:

from about 20 up to about 80 percent by weight of the ketone compound; and from about 20 up to about 80 percent by weight of the polar aprotic solvent.

12. A method of removing photoresist comprising:

preparing a composition for removing photoresist, the composition including a first polar aprotic solvent being at least one of an ether compound and an ester compound, and a second polar aprotic solvent being at least one of a sulfur-containing compound and a nitrogen-containing compound; and selectively removing a novolac-based photoresist from an object on which the novolac-based photoresist and a structure including an acryl-based resin are located by contacting the object with the composition while suppressing damage to the structure including the acryl-based resin.

13. The method of claim 12, wherein the composition for removing photoresist comprises, based on a total weight of the composition:

from about 10 up to about 80 percent by weight of the first polar aprotic solvent; and from about 20 up to about 90 percent by weight of the second polar aprotic solvent.

14. A method of removing photoresist comprising:

preparing a composition for removing photoresist, the composition consisting essentially of a ketone compound, a first polar aprotic solvent and a second polar aprotic solvent; and selectively removing a novolac-based photoresist from an object on which the novolac-based photoresist and a structure including an acryl-based resin are located by contacting the object with the composition while suppressing damage to the structure including the acryl-based resin, wherein the first polar aprotic solvent is at least one of an ether compound and an ester compound, and the second polar aprotic solvent is at least one of a sulfur-containing compound and a nitrogen-containing compound.

15. The method of claim 14, wherein the composition for removing photoresist consists essentially of, based on a total weight of the composition:

from about 20 to about 50 percent by weight of the ketone compound;

from about 40 to about 70 percent by weight of the first polar aprotic solvent; and from about 10 to about 40 percent by weight of the second polar aprotic solvent.

16. The method of claim 14, wherein the composition for removing photoresist consists essentially of:

the ketone compound;

the ester compound; and a nitrogen-containing polar aprotic solvent.

17. The method of claim 16, wherein the composition for removing photoresist consists essentially of:

the ketone compound selected from acetone, 2-butanone and methyl isobutylketone;

the ester compound selected from ethyl lactate, propylene glycol methyl ether acetate, ethylene glycol methyl ether acetate, γ-butyrolactone, ethyl 3-ethoxypropionate, carbitol acetate and dimethyl adipate; and the nitrogen-containing polar aprotic solvent selected from N-methyl-2-pyrrolidinone, dimethylformamide, dimethylacetamide, diethylacetamide and acetonitrile.

18. A method of removing photoresist comprising:

preparing a composition for removing photoresist, the composition consisting essentially of a ketone compound and a second polar aprotic solvent; and selectively removing a novolac-based photoresist from an object on which the novolac-based photoresist and a structure including an acryl-based resin are located by contacting the object with the composition while suppressing damage to the structure including the acryl-based resin, wherein the second polar aprotic solvent is at least one of a sulfur-containing compound and a nitrogen-containing compound.

19. The method of claim 18, wherein the composition for removing photoresist consists essentially of:

the ketone compound; and a nitrogen-containing polar aprotic solvent.

20. The method of claim 19, wherein the composition for removing photoresist consists essentially of:

the ketone compound selected from acetone, 2-butanone and methyl isobutylketone; and the nitrogen-containing polar aprotic solvent selected from N-methyl-2-pyrrolidinone, dimethylformamide, dimethylacetamide, diethylacetamide and acetonitrile.

21. A method of removing photoresist comprising:

preparing a composition for removing photoresist, the composition consisting essentially of a first polar aprotic solvent and a second polar aprotic solvent; and selectively removing a novolac-based photoresist from an object on which the novolac-based photoresist and a structure including an acryl-based resin are located by contacting the object with the composition while suppressing damage to the structure including the acryl-based resin, wherein the first polar aprotic solvent is at least one of an ether compound and an ester compound, and the second polar aprotic solvent is at least one of a sulfur-containing compound and a nitrogen-containing compound.

22. The method of claim 21, wherein the composition for removing photoresist consists essentially of:

the ester compound; and a nitrogen-containing polar aprotic solvent.

23. The method of claim 22, wherein the composition for removing photoresist consists essentially of:

the ester compound selected from ethyl lactate, propylene glycol methyl ether acetate, ethylene glycol methyl ether acetate, γ-butyrolactone, ethyl 3-ethoxypropionate, carbitol acetate and dimethyl adipate; and the nitrogen-containing polar aprotic solvent selected from N-methyl-2-pyrrolidinone, dimethylformamide, dimethylacetamide, diethylacetamide and acetonitrile.

24. The method of claim 1, wherein the composition for removing photoresist comprises:

the ketone compound;

the ester compound; and a nitrogen-containing polar aprotic solvent.

25. The method of claim 24, wherein the composition for removing photoresist comprises:

the ketone compound selected from acetone, 2-butanone and methyl isobutylketone;

the ester compound selected from ethyl lactate, propylene glycol methyl ether acetate, ethylene glycol methyl ether acetate, γ-butyrolactone, ethyl 3-ethoxypropionate, carbitol acetate and dimethyl adipate; and the nitrogen-containing polar aprotic solvent selected from N-methyl-2-pyrrolidinone, dimethylformamide, dimethylacetamide, diethylacetamide and acetonitrile.

26. The method of claim 8, wherein the composition for removing photoresist comprises:

the ketone compound; and the ester compound.

27. The method of claim 26, wherein the composition for removing photoresist comprises:

the ketone compound selected from acetone, 2-butanone and methyl isobutylketone; and the ester compound selected from ethyl lactate, propylene glycol methyl ether acetate, ethylene glycol methyl ether acetate, y-butyrolactone, ethyl 3-ethoxypropionate, carbitol acetate and dimethyl adipate.

28. The method of claim 10, wherein the composition for removing photoresist comprises:

the ketone compound; and a nitrogen-containing polar aprotic solvent.

29. The method of claim 28, wherein the composition for removing photoresist comprises:

the ketone compound selected from acetone, 2-butanone and methyl isobutylketone; and the nitrogen-containing polar aprotic solvent selected from N-methyl-2-pyrrolidinone, dimethylformamide, dimethylacetamide, diethylacetamide and acetonitrile.

30. The method of claim 12, wherein the composition for removing photoresist comprises:

the ester compound; and a nitrogen-containing polar aprotic solvent.

31. The method of claim 30, wherein the composition for removing photoresist comprises:

the ester compound selected from ethyl lactate, propylene glycol methyl ether acetate, ethylene glycol methyl ether acetate, y-butyrolactone, ethyl 3-ethoxypropionate, carbitol acetate and dimethyl adipate; and the nitrogen-containing polar aprotic solvent selected from N-methyl-2-pyrrolidinone, dimethylformamide, dimethylacetamide, diethylacetamide and acetonitrile.

32. The method of claim 1, wherein the acryl-based resin comprises a methacryl-based resin or a cross-linked methacryl-based resin.

33. A method of manufacturing a semiconductor device comprising:

forming a structure on a substrate, the structure including an acryl-based resin;

forming a photoresist pattern including a novolac-based photoresist on the substrate, the photoresist pattern exposing a portion of the structure; and selectively removing the photoresist pattern from the substrate by applying a composition for removing photoresist while suppressing damage to the structure including the acryl-based resin, the composition including a ketone compound, a first polar aprotic solvent being at least one of an ether compound and an ester compound, and a second polar aprotic solvent being at least one of a sulfur-containing compound and a nitrogen-containing compound.

34. The method of claim 33, wherein forming the structure comprises:

forming a first photosensitive film on the substrate including a photodiode and a metal pattern thereon;

forming a color filter on the first photosensitive film;

forming a second photosensitive film on the first photosensitive film and the color filter; and forming a microlens on the second photosensitive film, wherein at least one of the first photosensitive film, the color filter, the second photosensitive film and the microlens includes the acryl-based resin.

35. The method of claim 33, wherein forming the structure comprises:

forming a photodiode on the substrate;

forming a transistor on the substrate, the transistor being connected to the photodiode;

forming an insulation layer on the transistor and the substrate;

partially etching the insulation layer to form a first contact hole exposing a portion of the transistor;

forming a first metal pad to fill the first contact hole;

forming an insulation interlayer on the first metal pad and the insulation layer;

partially etching the insulation interlayer to form a second contact hole exposing the first metal pad;

forming a second metal pad to fill the second contact hole;

forming a first photosensitive film on the second metal pad and the insulation interlayer;

forming a color filter on the first photosensitive film;

forming a second photosensitive film on the first photosensitive film and the color filter; and forming a microlens on the second photosensitive film;

wherein at least one of the first photosensitive film, the color filter, the second photosensitive film and the microlens includes the acryl-based resin.

36. A method of manufacturing a semiconductor device comprising:

forming a structure on a substrate, the structure including an acryl-based resin;

forming a photoresist pattern including a novolac-based photoresist on the substrate, the photoresist pattern exposing a portion of the structure; and selectively removing the photoresist pattern from the substrate by applying a composition for removing photoresist while suppressing damage to the structure including the acryl-based resin, the composition including a ketone compound and a first polar aprotic solvent having at least one of an ether compound and an ester compound.

37. A method of manufacturing a semiconductor device comprising:

forming a structure on a substrate, the structure including an acryl-based resin;

forming a photoresist pattern including a novolac-based photoresist on the substrate, the photoresist pattern exposing a portion of the structure; and selectively removing the photoresist pattern from the substrate by applying a composition for removing photoresist while suppressing damage to the structure including the acryl-based resin, the composition including a ketone compound and a second polar aprotic solvent having at least one of a sulfur-containing compound and a nitrogen-containing compound.

38. The method of claim 37, wherein the composition for removing photoresist comprises, based on a total weight of the composition:

from about 20 up to about 80 percent by weight of the ketone compound; and from about 20 up to about 80 percent by weight of the second polar aprotic solvent.

39. A method of manufacturing a semiconductor device comprising:

forming a structure on a substrate, the structure including an acryl-based resin;

forming a photoresist pattern including a novolac-based photoresist on the substrate, the photoresist pattern exposing a portion of the structure; and selectively removing the photoresist pattern from the substrate by applying a composition for removing photoresist while suppressing damage to the structure including the acryl-based resin, the composition including a first polar aprotic solvent being at least one of an ether compound and an ester compound and a second polar aprotic solvent being at least one of a sulfur-containing compound and a nitrogen-containing compound.

* * * * *